US006007872A

United States Patent [19]

Lindhe et al.

[11] Patent Number: 6,007,872

[45] Date of Patent: Dec. 28, 1999

[54] METHOD OF PRODUCING IMPREGNATED WOODEN PRODUCTS

[76] Inventors: Curt Lindhe, Mårtsbovägen 20, S-777, Söderbärke; Lennart Castwall, Kanalvägen 20, S-184 41, Åkersberga, both of Sweden

[21] Appl. No.: 08/894,651

[22] PCT Filed: Feb. 2, 1996

[86] PCT No.: PCT/SE96/00126

§ 371 Date: Aug. 25, 1997

§ 102(e) Date: Aug. 25, 1997

[87] PCT Pub. No.: WO96/26054

PCT Pub. Date: Aug. 29, 1996

[30] Foreign Application Priority Data

Feb. 24, 1995 [SE] Sweden ..... 9500689

[51] Int. Cl.[6] ..... B05D 1/18

[52] U.S. Cl. ..... 427/325; 427/440

[58] Field of Search ..... 427/393, 393.1, 427/440

[56] References Cited

U.S. PATENT DOCUMENTS

| | | | |
|---|---|---|---|
| 3,950,577 | 4/1976 | Fry | 427/365 |
| 5,652,065 | 7/1997 | Park et al. | 428/537.1 |
| 5,678,618 | 10/1997 | Lindhe et al. | 144/361 |

FOREIGN PATENT DOCUMENTS

| | | |
|---|---|---|
| 100 792 | 12/1916 | United Kingdom . |
| 233 778 | 5/1925 | United Kingdom . |
| 487 661 | 6/1938 | United Kingdom . |

OTHER PUBLICATIONS

Patent Abstracts of Japan, vol. 16, No 153, M–1235, abstract of JP<A,4–7101, Jan. 10, 1992.

Derwent's abstract, No. 87–92305/13, week 8713, Abstract of SU 1248802, Aug. 7, 1986.

*Primary Examiner*—Shrive Beck
*Assistant Examiner*—Jennifer Calcagni
*Attorney, Agent, or Firm*—Pillsbury Madison & Sutro LLP

[57] ABSTRACT

The present invention relates to a method of producing an impregnated wooden product from a wooden article. The article is pressed isostatically with a pressure exceeding 1,000 bars in a first method step. The wooden article is then placed in a bath containing a liquid-impregnating agent in a second method step and allowed to swell so that at least a part of the impregnating agent is absorbed by the article. The method may optionally be supplemented with a third method step in which the article is pressed isostatically with a pressure exceeding 1,000 bars, so as to form a hard element. The third method step may alternatively be applied to a conventionally pressure-impregnated article.

1 Claim, No Drawings

METHOD OF PRODUCING IMPREGNATED WOODEN PRODUCTS

This application is the national phase of international application PCT/SE96/00126 filed Feb. 2, 1996 which designated the U.S.

The present invention relates to a method of producing impregnated wooden products from wooden articles.

Various impregnating methods are known for treating wooden articles with the intention of preventing the occurrence of wood mould and wood rot. Such methods may involve placing the articles in a chamber, evacuating the chamber, introducing an impregnating agent thereinto, and then re-pressurizing the chamber. The impregnating liquid enters the wood cells to a greater or a lesser extent.

It is also known to produce hard elements, for instance floor boarding, by compressing different types of wooden products in conventional presses. The pressures applied in this regard do not normally exceed 500 bars, even though much higher pressures have been proposed. The use of these much higher pressures has not found practical use in the present context however, due to the fact that in conventional presses these high pressures can only be achieved in the case of very limited surface areas.

Application of this latter method normally results in considerable deformation of the material during compression. This deformation is not only caused in the direction in which the pressing forces act, but also transversely to this direction. This is because the material is pressed between an upper and a lower press plate which enables the wooden articles to expand freely in a lateral direction. When counter-pressure devices are used to impede this lateral expansion of the material, the presses become complicated and their use is limited to specific dimensions; see for instance Swedish Publication SE 601162 in this regard.

Patent abstract of Japan, vol. 16, No. 153, m-1235, abstract of JP-A-4-7101, discloses a method where wooden articles are compressed in a conventional pressing apparatus in a first step. The article is then immersed in a treating liquid in order to impregnate the article. Finally, the article is dried by treatment with heat.

Swedish Patent Application 9303821-4 describes a method of producing hard elements from a wooden article by applying very high pressures, i.e. pressures higher than 1,000 bars, and an isostatic pressing process, i.e. a process in which a uniform pressure is applied over the whole of the outer surface of the article. These high pressures can be applied to large surface areas by means of a so-called Quintuspress.

The present invention relates to a further development of the method described in the aforesaid Swedish and Japanese patent applications, and the object of the invention is to provide an impregnating method which will produce fire-retardant and/or rot-resistant and/or shape-durable elements and hard, impregnated elements respectively.

This article is achieved with a method having the characteristic features set forth in the following claim.

In the method according to the present invention, a wooden article is pressed isostatically in a first step at a pressure in excess of 1,000 bars, either in a so-called Quintuspress or by means of some other appropriate pressing method. In this regard, the extent to which the article is compressed will depend on its dry solids content, the fibre direction, its hardness and other properties. However, one of the cross-sectional dimensions of the article will normally be reduced by between 20–50% in the pressing operation, wherewith the wood cells are pressed together. The wooden article is then relieved of load.

The article is placed in a liquid bath containing impregnating agent in a second step, wherein the article successively swells as a result of liquid penetrating into and being absorbed by the wood cells. The liquid penetrates into the cells so that the article is completely impregnated throughout. Expansion of the article is contingent on the material properties thereof and also on the time during which the article remains in the bath, among other things. Normally, a marked expansion takes place within the course of some hours, and the material returns to its original form within this time period in certain cases. Suitable impregnating agents are fire-retardant liquids, rot-retardant liquids or glue. However, in order for the liquid to penetrate into the cells, it is necessary for the liquid to have a high wood penetration capacity.

Tests have been carried out with pine test pieces having a thickness of 24 mm, which was reduced to 12 mm by the isostatic pressing operation, whereby the density of the test pieces increased to immediately below 1 kg/dm$^3$. When placed in a bath containing a fire-retardant agent, the test pieces expanded to their original size within the space of one hour. The test pieces were then dried and divided into smaller parts and attempts were made to ignite parts which had been located centrally in the article and parts which had been located on the sides thereof. It was, however, impossible to ignite any of these parts, which indicated that the fire-retardant liquid had penetrated to the central parts of the article.

In the third step of the aforesaid method, the article is again compressed isostatically at a pressure exceeding 1,000 bars, therewith obtaining a hard element which is fire-resistant, rot-resistant and also shape-durable when glue is used.

We claim:

1. A method of producing an impregnated wooden product from a wooden article, comprising a) pressing the wooden article to substantially compact the wood;

b) after step a), immersing the compressed wooden article in a bath of liquid impregnating agent whereby the immersed article is permitted to swell so that at least a part of the impregnating agent is absorbed by the article; and c) after step b), pressing the wooden article a second time, characterized in that the wooden article is compressed by an isostatic pressure exceeding 1,000 bars in steps a) and c); and where the impregnating agent is a fire-retardant agent, a rot-preventing agent or a glue.

* * * * *